US010829709B2

(12) United States Patent
Taribagil et al.

(10) Patent No.: US 10,829,709 B2
(45) Date of Patent: Nov. 10, 2020

(54) VISCOSITY INDEX IMPROVER CONCENTRATES FOR LUBRICATING OIL COMPOSITIONS

(71) Applicant: Infineum International Limited, Abingdon (GB)

(72) Inventors: Rajiv Taribagil, Edison, NJ (US); Isabella Goldmints, Niskayuna, NY (US); Stuart Briggs, Edison, NJ (US); Bogdan Barboiu, Mountainside, NJ (US); Richard D. Bertram, Witney (GB); Robin H. Scott, Abingdon (GB)

(73) Assignee: Infineum International Limited (GB)

( * ) Notice: Subject to any disclaimer, the term of this patent is extended or adjusted under 35 U.S.C. 154(b) by 0 days.

(21) Appl. No.: 14/520,424

(22) Filed: Oct. 22, 2014

(65) Prior Publication Data

US 2015/0184105 A1 Jul. 2, 2015

Related U.S. Application Data

(63) Continuation-in-part of application No. 14/146,035, filed on Jan. 2, 2014.

(51) Int. Cl.

| | |
|---|---|
| ***C10M 173/02*** | (2006.01) |
| ***C10L 1/16*** | (2006.01) |
| ***C10M 107/14*** | (2006.01) |
| ***C10M 169/04*** | (2006.01) |
| *C10N 20/04* | (2006.01) |
| *C10N 30/02* | (2006.01) |
| *C10N 30/00* | (2006.01) |
| *C10N 40/25* | (2006.01) |
| *C10N 70/00* | (2006.01) |

(52) U.S. Cl.

CPC ..... *C10M 107/14* (2013.01); *C10M 169/04* (2013.01); *C10M 2203/1025* (2013.01); *C10M 2205/04* (2013.01); *C10N 2020/04* (2013.01); *C10N 2030/02* (2013.01); *C10N 2030/70* (2020.05); *C10N 2030/74* (2020.05); *C10N 2040/252* (2020.05); *C10N 2070/02* (2020.05)

(58) Field of Classification Search

CPC ..... C10M 143/12; C10M 2205/06; C10M 107/14; C10M 169/04; C10M 2205/04; C10M 2203/1025; C10N 2020/04; C10N 2030/02; C10N 2030/70; C10N 2030/74; C10N 2040/252; C10N 2070/02

USPC ..... 508/507, 591

See application file for complete search history.

(56) References Cited

U.S. PATENT DOCUMENTS

| | | | | |
|---|---|---|---|---|
| 3,795,615 | A | 3/1974 | Pappas et al. | |
| 3,965,019 | A | 6/1976 | St. Clair et al. | |
| 4,032,459 | A | 6/1977 | Crossland et al. | |
| 4,073,737 | A | 2/1978 | Elliott | |
| 4,194,057 | A | 3/1980 | Brankling et al. | |
| 5,223,579 | A | 6/1993 | Rhodes et al. | |
| 5,278,252 | A | 1/1994 | Rhodes et al. | |
| 5,458,792 | A | 10/1995 | Rhodes et al. | |
| 5,747,433 | A | 5/1998 | Luciani et al. | |
| 7,163,913 | B2 * | 1/2007 | Briggs | C08L 15/00 508/591 |
| 2006/0052255 | A1 | 3/2006 | Abraham et al. | |
| 2006/0199743 | A1 * | 9/2006 | Rosenbaum | C10M 107/02 508/110 |
| 2008/0153721 | A1 * | 6/2008 | Rosenbaum | C10M 101/02 508/110 |

FOREIGN PATENT DOCUMENTS

| | | | |
|---|---|---|---|
| EP | 1486557 | A1 | 12/2004 |
| EP | 2192168 | A1 | 6/2010 |
| WO | WO2012/017023 | A1 | 2/2012 |

OTHER PUBLICATIONS

Anonymous, Effect of Antioxidants on the Viscosity Stability of Viscosity Index Improver Concentrates in Low Sulfur Diluents, PriorArtDatabase, Oct. 26, 2011, p. 1-5.

* cited by examiner

*Primary Examiner* — Prem C Singh
*Assistant Examiner* — Francis C Campanell

(57) ABSTRACT

Concentrates of linear, block copolymers having a polymer block derived from a monoalkenyl arene, covalently linked to one or more blocks of a hydrogenated derivative of a conjugated diene copolymer, dissolved in highly saturated diluent oil, wherein the size of the monoalkenyl arene block is controlled to provide an optimized level of incompatibility of the block copolymer in the selected diluent.

6 Claims, No Drawings

VISCOSITY INDEX IMPROVER CONCENTRATES FOR LUBRICATING OIL COMPOSITIONS

The present application is a continuation-in-part of U.S. patent application Ser. No. 14/146,035, filed on Jan. 2, 2014 and titled "Viscosity Index Improver Concentrates for Lubricating Oil Compositions".

FIELD OF THE INVENTION

The invention is directed to viscosity index improver concentrates containing a viscosity index improver polymer in diluent oil. More specifically, the present invention is directed to concentrates of linear, di- or tri-block copolymers comprising a polymer block derived from a monoalkenyl arene covalently linked to one or more blocks of a hydrogenated derivative of a conjugated copolymer derived from diene, dissolved in diluent oil having a saturates content of greater than 90 mass %, wherein the size of the monoalkenyl arene block is controlled to provide optimized dissolution of the polymer in the diluent under conventional manufacturing conditions to yield stable viscosity index improver concentrates containing maximized polymer concentrations, such as polymer concentrations of from about 3 mass % to about 30 mass %.

BACKGROUND OF THE INVENTION

Lubricating oils for use in crankcase engine oils contain components that are used to improve the viscometric performance of the engine oil, i.e., to provide multigrade oils such as SAE 5W-30, 10W-30 and 10W-40. These viscosity performance enhancers, commonly referred to as viscosity index (VI) improvers include olefin copolymers, polymethacrylates, arene/hydrogenated diene block linear and star copolymers, and hydrogenated isoprene star polymers.

VI improvers are commonly provided to lubricating oil blenders as a concentrate in which the VI improver polymer is diluted in oil to allow, inter alia, for more facile dissolution of the VI improver in the base stock oil. A typical VI improver concentrate conventionally contains only about 3 or 4 mass % active polymer, with the remainder being diluent oil. A typical formulated multigrade crankcase lubricating oil may, depending on the thickening efficiency (TE) of the polymer, require as much as 3 mass % of active VI improver polymer. An additive concentrate providing this amount of polymer can introduce as much as 20 mass %, based on the total mass of the finished lubricant, of diluent oil. As the additive industry is highly competitive from a pricing standpoint, and diluent oil represents one of the largest raw material costs to the additive manufacturers, VI improver concentrates have commonly contained the least expensive oil capable of providing suitable handling characteristics; usually a solvent neutral (SN) 100 or SN150 Group 1 oil.

There has been a continued demand for lubricating oil compositions providing improved fuel economy and low temperature viscometric performance. Much effort has been made in these respects to select the proper base oil or base stock blend when formulating the lubricant. As conventional VI improver concentrates, introduce large quantities of diluent oil, particularly Group I diluent oil, into the finished lubricant, the finished lubricant formulator has needed to add a quantity of relatively high quality base stock oil, as a correction fluid, to insure the low temperature viscometric performance of the finished lubricant remained within specification. Previously, it was suggested that this issue could be addressed by using a higher quality diluent oil, such as a Group II, and particularly Group III, diluent oil.

Linear arene/hydrogenated diene block copolymer VI improvers have been found to provide excellent performance in terms of thickening efficiency (TE) and shear stability index (SSI) performance relative to olefin copolymer (OCP) and polymethacrylate (PMA) VI improvers. In addition, linear arene/hydrogenated diene block copolymer VI improvers have been found to provide soot-dispersing properties, that are particularly advantageous when the VI improver is used to formulate a lubricating oil composition for use in engines that generate large amounts of soot, such as in heavy duty diesel (HDD) engines, particularly heavy duty diesel engines equipped with exhaust gas recirculation (EGR) systems.

However, it was found that in Group II and particularly Group III diluent oils, which have saturates contents above 90 mass %, linear arene/hydrogenated diene block copolymers could only be dissolved at high temperature, and that even when dissolved at high temperature, the amount of such polymers that that could be dissolved to form a stable VI improver concentrate remained low (e.g., a maximum of 3 to 5 mass %).

As lubricating oil performance standards have become more stringent, there has been a continuing need to identify components capable of improving overall lubricant performance. Therefore, it would be advantageous to be able to provide a concentrate of linear arene/hydrogenated diene block copolymer VI improver in Group II or Group III diluent oil that delivers the polymer to finished lubricant in the most concentrated form possible, preferably a concentrate that can be formed under standard manufacturing conditions (no heating above 140° C.) to yield a kinetically stable VI improver concentrate, thereby minimizing the amount of associated diluent oil concurrently introduced into the finished lubricant by the concentrate.

SUMMARY OF THE INVENTION

While not wishing to be bound by any specific theory, it has been found that when block copolymers having a block derived from monoalkenyl arene (such as a block derived from styrene) covalently linked to a hydrogenated polydiene block (such as a block derived from isoprene, butadiene or a mixture thereof) are dispersed in highly saturated diluent oils, the polystyrene blocks of the block copolymer chains aggregate (associate) to form micelles having an oil-devoid region at the core, surrounded by a brush-like layer, called a corona, made up of the polydiene chains. Micelle formation appears to be driven primarily by an unfavorable interaction (incompatibility) between the polystyrene blocks and the highly saturated diluent oil. This incompatibility also may dictate certain morphological attributes, such as the number of chains per micelle, which, in turn, may influence the number density of micelles and the thickening efficiency of the associated polymer chains. An excessively high level of incompatibility may prevent the formation of a kinetically stable concentrate, (a concentrate with which performance is uninfluenced by the temperature at which, or the time the concentrate is stored). Conversely, an excessively low level of incompatibility can reduce the degree to which the polystyrene blocks aggregate, and can adversely impact the thickening efficiency of the copolymer. The present inventors have found that to provide an optimized VI improver concentrate, the level of incompatibility between the polyarene blocks of the block copolymer and the selected highly saturated diluent oil must be controlled to be within an optimum range and, that the level of compatibility can be controlled by controlling the size of the block derived from monoalkenyl arene monomer.

Therefore, in accordance with a first aspect of the invention, there are provided concentrates of linear, block copolymers comprising a polymer block derived from a monoalkenyl arene, covalently linked to one or more blocks of a hydrogenated derivative of a conjugated diene copolymer, dissolved in a highly saturated diluent oil, wherein the size of the monoalkenyl arene block is controlled to provide optimized level of incompatibility of the polymer in the diluent.

In accordance with a second aspect of the invention, there is provided a polymer concentrate, as in the first aspect, that can be manufactured under standard manufacturing conditions, and is stable and contains a maximized polymer concentration, such as polymer concentrations of from about 3 mass % to about 30 mass %.

In accordance with a third aspect of the invention, there is provided a polymer concentrate, as in the first aspect, wherein the polymer is a hydrogenated diblock copolymer comprising a polystyrene block covalently bonded to a polydiene block, the polydiene block preferably being a random copolymer of isoprene and butadiene.

In accordance with a fourth aspect of the invention, there is provided a method of modifying the viscosity index of a lubricating oil composition comprising a major amount of oil of lubricating viscosity, which method comprises adding to said oil of lubricating viscosity an effective amount of the polymer concentrate of the first, second or third aspect.

DETAILED DESCRIPTION OF THE INVENTION

Oils of lubricating viscosity useful as the diluents of the present invention have a saturates content of at least 90 mass % and may be selected from natural lubricating oils, synthetic lubricating oils and mixtures thereof.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Suitable diluent oils also include oils derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as diluent oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

The diluent oil may comprise a Group II, Group III, Group IV or Group V oil or blends of the aforementioned oils. Preferably, the diluent oil is a Group III oil, a mixture of two or more Group III oils, or a mixture of one or more Group III oils with one or more Group IV and/or Group V oils.

Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.3 percent sulfur and have a viscosity index greater than or equal to 80 and less than 120 using the test methods specified in Table 1.

b) Group II oils contain greater than or equal to 90 percent saturates and less than or equal to 0.3 percent sulfur and have a viscosity index greater than or equal to 80 and less than 120 using the test methods specified in Table 1. Although not a separate Group recognized by the API, Group II oils having a viscosity index greater than about 110 are often referred to as "Group II+" oils.

c) Group III oils contain greater than or equal to 90 percent saturates and less than or equal to 0.3 percent sulfur and have a viscosity index greater than or equal to 120 using the test methods specified in Table 1.

d) Group IV oils are polyalphaolefins (PAO).

e) Group V oils are all other base stocks not included in Group I, II, III, or IV.

TABLE 1

| Property | Test Method |
|---|---|
| Saturates | ASTM D2007 |
| Viscosity Index | ASTM D2270 |
| Sulfur | ASTM D4294 |

Diluent oil useful in the practice of the invention preferably have a CCS at −35° C. of less than 3700 cPs, such as less than 3300 cPs, preferably less than 3000 cPs, such as less than 2800 cPs and more preferably less than 2500 cPs, such as less than 2300 cPs.

Diluent oil useful in the practice of the invention also preferably have a kinematic viscosity at 100° C. ($kv_{100}$) of at least 3.0 cSt (centistokes), such as from about 3 cSt to 6 cSt, especially from about 3 cSt to 5 cSt, such as from about 3.4 to 4 cSt. More active polymer may be required to provide suitable viscometrics when lower viscosity diluent oil is used.

Preferably the volatility of the diluent oil, as measured by the Noack test (ASTM D5880), is less than or equal to about 40%, such as less than or equal to about 35%, preferably less than or equal to about 32%, such as less than or equal to about 28%, more preferably less than or equal to about 16%. Using a diluent oil having a greater volatility makes it difficult to provide a formulated lubricant having a Noack volatility of less than or equal to 15%. Formulated lubricants having a higher level of volatility may display fuel economy debits. Preferably, the viscosity index (VI) of the diluent oil is at least 85, preferably at least 100, most preferably from about 105 to 140.

Polymers useful in the practice of the present invention are linear, hydrogenated block copolymers comprising a polymer block derived from a monoalkenyl arene, covalently linked to one or more blocks of conjugated diene monomer(s). Preferably the monoalkenyl arene is styrene and the diene is isoprene, butadiene or a mixture thereof. More preferably, the polymer is a diblock copolymer comprising a polystyrene block covalently linked to block comprising a random copolymer of isoprene and butadiene.

Suitable monoalkenyl arene monomers include monovinyl aromatic compounds, such as styrene, monovinylnaphthalene, as well as the alkylated derivatives thereof, such as o-, m- and p-methylstyrene, alpha-methyl styrene and tertiary butylstyrene. As noted above, the preferred monoalkenyl arene is styrene.

Isoprene monomers that may be used as the precursors of the copolymers of the present invention can be incorporated into the polymer as either 1,4- or 3,4-configuration units, and mixtures thereof. Preferably, the majority of the isoprene is incorporated into the polymer as 1,4-units, such as greater than about 60 mass %, more preferably greater than about 80 mass %, such as about 80 to 100 mass %, most preferably greater than about 90 mass %, such as about 93 mass % to 100 mass %.

Butadiene monomers that may be used as the precursors of the copolymers of the present invention can also be incorporated into the polymer as either 1,2- or 1,4-configuration units. In the polymers of the present invention, at least about 70 mass %, such as at least about 75 mass %, preferably at least about 80 mass %, such as at least about 85 mass %, more preferably at least about 90, such as 95 to 100 mass % of the butadiene is incorporated into the polymer as 1,4-configuration units.

Useful copolymers include those prepared in bulk, suspension, solution or emulsion. As is well known, polymerization of monomers to produce hydrocarbon polymers may be accomplished using free-radical, cationic and anionic initiators or polymerization catalysts, such as transition metal catalysts used for Ziegler-Natta and metallocene type catalysts. Preferably, the block copolymers of the present invention are formed via anionic polymerization as anionic polymerization has been found to provide copolymers having a narrow molecular weight distribution (Mw/Mn), such as a molecular weight distribution of less than about 1.2.

As is well known, and disclosed, for example, in U.S. Pat. No. 4,116,917, living polymers may be prepared by anionic solution polymerization of a mixture of the conjugated diene monomers in the presence of an alkali metal or an alkali metal hydrocarbon, e.g., sodium naphthalene, as anionic initiator. The preferred initiator is lithium or a monolithium hydrocarbon. Suitable lithium hydrocarbons include unsaturated compounds such as allyl lithium, methallyl lithium; aromatic compounds such as phenyllithium, the tolyllithiums, the xylyllithiums and the naphthyllithiums, and in particular, the alkyl lithiums such as methyllithium, ethyllithium, propyllithium, butyllithium, amyllithium, hexyllithium, 2-ethylhexyllithium and n-hexadecyllithium. Secondary-butyllithium is the preferred initiator. The initiator(s) may be added to the polymerization mixture in two or more stages, optionally together with additional monomer. The living polymers are olefinically unsaturated.

The living random diene copolymer blocks may be represented by the formula A-M, wherein M is a carbanionic group, i.e., lithium, and A is a random copolymer of polyisoprene and polybutadiene. As noted supra, in the absence of the proper control of the polymerization, the resulting copolymer will not be a random copolymer and will instead comprise a polybutadiene block, a tapered segment containing both butadiene and isoprene addition product, and a polyisoprene block. To prepare a random copolymer, the more reactive butadiene monomer may be added gradually to the polymerization reaction mixture containing the less reactive isoprene such that the molar ratio of the monomers in the polymerization mixture is maintained at the required level. It is also possible to achieve the required randomization by gradually adding a mixture of the monomers to be copolymerized to the polymerization mixture. Living random copolymers may also be prepared by carrying out the polymerization in the presence of a so-called randomizer. Randomizers are polar compounds that do not deactivate the catalyst and randomize the manner in which the monomers are incorporated into to the polymer chain. Suitable randomizers are tertiary amines, such as trimethylamine, triethylamine, dimethylamine, tri-n-propylamine, tri-n-butylamine, dimethylaniline, pyridine, quinoline, N-ethylpiperidine, N-methylmorpholine; thioethers, such as dimethyl sulfide, diethyl sulfide, din-propyl sulfide, di-n-butyl sulfide, methyl ethyl sulfide; and in particular, ethers such as dimethyl ether, methyl ether, diethyl ether, di-n-propyl ether, di-n-butyl ether, di-octyl ether, di-benzyl ether, di-phenyl ether, anisole, 1,2-dimethyloxyethane, o-dimethyloxy benzene, and cyclic ethers, such as tetrahydrofuran.

Even with controlled monomer addition and/or the use of a randomizer, the initial and terminal portions of the polymer chains may have greater than a "random" amount of polymer derived from the more reactive and less reactive monomer, respectively. Therefore, for the purpose of this invention, the term "random copolymer" means a polymer chain, or a polymer block, the preponderance of which (greater than 80%, preferably greater than 90%, such as greater than 95%) results from the random addition of comonomer materials.

The block copolymers of the present invention may be, and are preferably, prepared by step-wise polymerization of the monomers e.g., polymerizing the random polyisoprene/polybutadiene copolymer, as described above, followed by the addition of the other monomer, specifically monoalkenyl arene monomer, to form a living polymer having the formula polyisoprene/polybutadiene-polyalkenyl arene-M. Alternatively, the order can be reversed, and the monoalkenyl arene block can be polymerized first, followed by the addition of the mixture of isoprene/butadiene monomer to form a living polymer having the formula polymonoalkenyl arene-polyisoprene/polybutadiene-M.

The solvents in which the living polymers are formed are inert liquid solvents, such as hydrocarbons e.g., aliphatic hydrocarbons such as pentane, hexane, heptane, oxtane, 2-ethylhexane, nonane, decane, cyclohexane, methylcyclohexane, or aromatic hydrocarbons e.g., benzene, toluene, ethylbenzene, the xylenes, diethylbenzenes, propylbenzenes. Cyclohexane is preferred. Mixtures of hydrocarbons e.g., lubricating oils, may also be used.

The temperature at which the polymerization is conducted may be varied within a wide range, such as from about −50° C. to about 150° C., preferably from about 20° C. to about 80° C. The reaction is suitably carried out in an inert atmosphere, such as nitrogen, and may optionally be carried out under pressure e.g., a pressure of from about 0.5 to about 10 bars.

The concentration of the initiator used to prepare the living polymer may also vary within a wide range and is determined by the desired molecular weight of the living polymer.

The resulting linear block copolymers can then be hydrogenated using any suitable means. A hydrogenation catalyst may be used e.g. a copper or molybdenum compound. Catalysts containing noble metals, or noble metal-containing compounds, can also be used. Preferred hydrogenation catalysts contain a non-noble metal or a non-noble metal-containing compound of Group VIII of the periodic Table i.e., iron, cobalt, and particularly, nickel. Specific examples of preferred hydrogenation catalysts include Raney nickel and nickel on kieselguhr. Particularly suitable hydrogenation catalysts are those obtained by causing metal hydrocarbyl compounds to react with organic compounds of any one of the group VIII metals iron, cobalt or nickel, the latter compounds containing at least one organic compound that is attached to the metal atom via an oxygen atom as described, for example, in U.K. Patent No. 1,030,306. Preference is given to hydrogenation catalysts obtained by causing an aluminum trialkyl (e.g. aluminum triethyl ($Al(Et_3)$) or aluminum triisobutyl) to react with a nickel salt of an organic acid (e.g. nickel diisopropyl salicylate, nickel naphthenate, nickel 2-ethyl hexanoate, nickel di-tert-butyl benzoate, nickel salts of saturated monocarboxylic acids obtained by reaction of olefins having from 4 to 20 carbon atoms in the molecule with carbon monoxide and water in the presence of acid catalysts) or with nickel enolates or phenolates (e.g., nickel acetonylacetonate, the nickel salt of butylacetophenone). Suitable hydrogenation catalysts will be well known to those skilled in the art and the foregoing list is by no means intended to be exhaustive.

The hydrogenation of the polymers of the present invention is suitably conducted in solution, in a solvent which is inert during the hydrogenation reaction. Saturated hydrocarbons and mixtures of saturated hydrocarbons are suitable. Advantageously, the hydrogenation solvent is the same as the solvent in which polymerization is conducted. Suitably, at least 50%, preferably at least 70%, more preferably at least 90%, most preferably at least 95% of the original olefinic unsaturation is hydrogenated.

The hydrogenated block copolymer may then be recovered in solid form from the solvent in which it is hydrogenated by any convenient means, such as by evaporating the solvent. Alternatively, oil e.g. lubricating oil, may be added to the solution, and the solvent stripped off from the mixture so formed to provide a concentrate. Suitable concentrates contain from about 3 mass % to about 25 mass %, preferably from about 5 mass % to about 15 mass % of the hydrogenated block copolymer.

Alternatively, the block copolymer may be selectively hydrogenated such that the olefin saturations are hydrogenated as above, while the aromatic unsaturations are hydrogenated to a lesser extent. Preferably, less than 10%, more preferably less than 5% of the aromatic unsaturations are hydrogenated. Selective hydrogenation techniques are also well known to those of ordinary skill in the art and are described, for example, in U.S. Pat. No. 3,595,942, U.S. Re. Pat. No. 27,145 and U.S. Pat. No. 5,166,277.

A hydrogenated random polyisoprene/polybutadiene copolymer block of the block copolymers of the present invention preferably has a weight ratio of polymer derived from isoprene to polymer derived from butadiene of from about 90:10 to about 70:30, more preferably from about 85:15 to about 75:25. The incorporation of additional ethylene units derived from the butadiene increases the TE of the resulting polymeric VI improver.

In the linear diblock copolymers of the present invention, the styrene block of the linear diblock copolymer may generally comprise from about 5 mass %, to about 60 mass %, preferably from about 20 mass %, to about 50 mass, of the diblock copolymer.

In linear diblock copolymers of the present invention, the hydrogenated random polyisoprene/polybutadiene copolymer block of the block copolymers of the present invention will generally have a weight average molecular weight of from about 4,000 to 150,000 daltons, preferably from about 20,000 to 120,000 daltons, more preferably from about 30,000 to about 100,000 daltons. The size of the styrene block of the block copolymer should be sufficient to facilitate aggregation (association) with the styrene blocks of the other block copolymers in oil to form the micelles and, therefore, should have a weight average molecular weight of at least 4,000 daltons, preferably of at least 5,000 daltons. The styrene block of the block copolymers of the present invention will generally have a weight average molecular weight of from about 4,000 to about 50,000 daltons, preferably from about 10,000 to about 40,000 daltons, more preferably from about 15,000 to about 30,000 daltons. Overall, VI improvers that are block copolymers of the invention will generally have a weight average molecular weight of from about 10,000 to 200,000 daltons, preferably from about 30,000 to about 160,000 daltons, more preferably from about 45,000 to about 130,000 daltons. The term "weight average molecular weight", as used herein, refers to the weight average molecular weight as measured by Gel Permeation Chromatography ("GPC") with a polystyrene standard, subsequent to hydrogenation.

The linear diblock copolymers of the present invention are those displaying a $\Delta kv_{100} \leq 0.3$ in the highly saturated diluent oil selected for use, wherein $\Delta kv_{100}$ is the difference, as measured at 100° C. (ASTM D445) between the $kv_{100}$ of two blends of 1 mass % of the polymer in the diluent; the first blend being prepared at a temperature below the glass transition temperature (Tg) of the monoalkenyl arene material (100° C. for styrene) at which temperature inter- and intra-molecular dynamic processes are impeded; the second blend being prepared at a temperature between the glass transition temperature of the monoalkenyl arene material and the decomposition temperature thereof, at which temperature inter- and intra-molecular dynamic processes are facilitated. Representative temperatures for forming the first and second blends may be, for example, 60° C. and 180° C., respectively. The $\Delta kv_{100}$ value can be influenced by adjusting the size of the polystyrene block and, in accordance with the present invention, the size of the polystyrene block can be decreased as the degree of incompatibility between the diluent oil and styrene increases.

The polymer concentrates of the present invention exhibit optimum thickening efficiency in fully formulated lubricating oil compositions, and fully formulated lubricating oil compositions prepared using the concentrates of the present invention will provide viscometric properties uninfluenced by temperature or the length of storage time, and will further exhibit improved filterability properties.

The compositions of this invention are used principally in the formulation of crankcase lubricating oils for passenger car and heavy duty diesel engines, and comprise a major amount of an oil of lubricating viscosity, a VI improver as described above, in an amount effective to modify the viscosity index of the lubricating oil, and optionally other additives as needed to provide the lubricating oil composition with the required properties. The lubricating oil composition may contain the VI improver of the invention in an amount of from about 0.1 mass % to about 2.5 mass %, preferably from about 0.2 mass % to about 1.5 mass %, more preferably from about 0.3 mass % to about 1.3 mass %, stated as mass percent active ingredient (AI) in the total lubricating oil composition. The viscosity index improver of the invention may comprise the sole VI improver, or may be used in combination with other VI improvers, for example, in combination with an VI improver comprising polyisobutylene, copolymers of ethylene and propylene (OCP), polymethacrylates, methacrylate copolymers, copolymers of an unsaturated dicarboxylic acid and a vinyl compound, interpolymers of styrene and acrylic esters, and hydrogenated copolymers of styrene/isoprene, styrene/butadiene, and other hydrogenated isoprene/butadiene copolymers, as well as the partially hydrogenated homopolymers of butadiene and isoprene.

In addition to VI improver, crankcase lubricating oils for passenger car and heavy duty diesel engines conventionally contain one or more additional additives, such as ashless dispersants, detergents, antiwear agents, antioxidants, friction modifiers, pour point depressants, and foam control additives.

Ashless dispersants maintain in suspension oil insolubles resulting from oxidation of the oil during wear or combustion. They are particularly advantageous for preventing the precipitation of sludge and the formation of varnish, particularly in gasoline engines.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil and may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds and aromatic amines.

Known friction modifiers include oil-soluble organo-molybdenum compounds. Such organo-molybdenum friction modifiers also provide antioxidant and antiwear credits to a lubricating oil composition. As examples of such oil soluble organo-molybdenum compounds, there may be mentioned dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Other known friction modifying materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

It may also be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

Representative effective amounts of such additional additives, when used in crankcase lubricants, are listed below:

| ADDITIVE | Mass % (Broad) | Mass % (Preferred) |
|---|---|---|
| Ashless Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Basestock | Balance | Balance |

It may be desirable, although not essential to prepare one or more additive concentrates comprising additives (concentrates sometimes being referred to as additive packages) whereby several additives can be added simultaneously to the oil to form the lubricating oil composition. The final lubricant composition may employ from 5 to 25 mass %, preferably 5 to 18 mass %, typically 10 to 15 mass % of the concentrate, the remainder being oil of lubricating viscosity.

This invention will be further understood by reference to the following examples. In the following Examples, the properties of certain VI improvers are described using certain terms of art, which are defined below. In the Examples, all parts are parts by weight, unless otherwise noted.

"Shear Stability Index (SSI)" measures the ability of polymers used as V.I. improvers in crankcase lubricants to maintain thickening power during SSI is indicative of the resistance of a polymer to degradation under service conditions. The higher the SSI, the less stable the polymer, i.e., the more susceptible it is to degradation. SSI is defined as the percentage of polymer-derived viscosity loss and is calculated as follows:

$$SSI = 100 \times \frac{kv_{fresh} - kv_{after}}{kv_{fresh} - kv_{oil}}$$

wherein $kv_{fresh}$ is the kinematic viscosity of the polymer-containing solution before degradation and $kv_{after}$ is the kinematic viscosity of the polymer-containing solution after degradation. SSI is conventionally determined using ASTM D6278-98 (known as the Kurt-Orban (KO) or DIN bench test). The polymer under test is dissolved in suitable base oil (for example, solvent extracted 150 neutral) to a relative viscosity of 2 to 3 at 100° C. and the resulting fluid is pumped through the testing apparatus specified in the ASTM D6278-98 protocol.

"Thickening Efficiency (TE)" is representative of a polymers ability to thicken oil per unit mass and is defined as:

$$TE = \frac{2}{c\ln 2}\ln\left(\frac{kv_{oil+polymer}}{kv_{oil}}\right)$$

wherein c is polymer concentration (grams of polymer/100 grams solution), $kv_{oil+polymer}$ is kinematic viscosity of the polymer in the reference oil, and $kv_{oil}$ is kinematic viscosity of the reference oil.

"Cold Cranking Simulator (CCS)" is a measure of the cold-cranking characteristics of crankcase lubricants and is conventionally determined using a technique described in ASTM D5293-92.

"Scanning Brookfield" is used to measure the apparent viscosity of engine oils at low temperatures. A shear rate of approximately 0.2 $s^{-1}$ is produced at shear stresses below 100 Pa. Apparent viscosity is measured continuously as the sample is cooled at a rate of 1° C./h over the range of −5° C. to −40° C., or to the temperature at which the viscosity exceeds 40,000 mPa·s (cP). The test procedure is defined in ASTM D5133-01. The measurements resulting from the test method are reported as viscosity in mPa·s or the equivalent cP, the maximum rate of viscosity increase (Gelation Index) and the temperature at which the Gelation Index occurs.

"Mini Rotary Viscometer (MRV)-TP-1" measures yield stress and viscosity of engine oils after cooling at controlled rates over a period of 45 hours to a final test temperature between −15° C. and −40° C. The temperature cycle is defined in SAE Paper No. 850443, K. O. Henderson et al. Yield stress (YS) is measured first at the test temperature and apparent viscosity is then measured at a shear stress of 525 Pa over a shear rate of 0.4 to $15^{s-1}$. Apparent viscosity is reported in mPa·s, or the equivalent cP.

"Pour point" measures the ability of an oil composition to flow as the temperature is lowered. Performance is reported in degrees centigrade and is measured using the test procedure described in ASTM D97-02. After preliminary heating, the sample is cooled at a specified rate and examined at intervals of 3° C. for flow characteristics. The lowest temperature at which movement of the specimen is observed is reported as the pour point. Each of MRV-TP-1 and CCS is indicative of the low temperature viscometric properties of oil compositions.

EXAMPLES

Diblock copolymers having a styrene block and an diene block derived from either isoprene, or a mixture of isoprene and butadiene, were prepared, which diblock polymers had the compositions shown below. Concentrates containing 6 mass % of these polymers in a Group III diluent oil (Shell XHV15.2, having a saturates content of 97.9 mass %, a viscosity index of 144 and a sulfur content of 0.01 mass %) were then prepared by dissolving the polymer in the diluent oil at 125° C. and the $\Delta kv_{100}$ s of the polymers in the selected diluent oil were measured.

TABLE 1

| Example | PS Block (kDa)[a] | Diene Block (kDa)[b] | Butadiene Content (%)[c] | $\Delta kv_{100}$ (cSt) |
|---|---|---|---|---|
| 1 | 35.5 | 94.6 | 0 | 0.51 |
| 2 | 28.1 | 97.3 | 22.0 | 0.83 |
| 3 | 27.1 | 87.4 | 19.0 | 0.22 |
| 4 | 26.1 | 87.7 | 22.3 | 0.15 |
| 5 | 24.5 | 92.5 | 18 | 0.22 |
| 6 | 22.8 | 89.7 | 18.5 | 0.19 |

[a]Polystyrene equivalent molecular weight of the polystyrene block
[b]Polystyrene equivalent molecular weight of the polydiene block (before hydrogenation)
[c]Butadiene content of the polydiene block (before hydrogenation)

The concentrates of Examples 3 through 6, in which the polymer demonstrated a $\Delta kv_{100}$ of less than 0.3 in the selected diluent oil, represent the present invention. Compared to the concentrates of Examples 1 and 2, the concentrates representing the invention provided improved storage stability.

The use of a VM concentrate including a diluent having a saturates level of greater than 90 mass % and a copolymer of the present invention, which can be dissolved in such diluent, provides a lubricant formulator with a number of benefits.

Table 2 presents the results of a blend study on 10W-40 grade heavy duty diesel (HDD) formulations, each blended to have a $k_{\nu 100}$ value of 13.85 cSt using the same commercial additive package containing dispersant, detergent and anti-wear agents and either a 4 cSt. Group III base oil, or a basestock blend of 4 cSt. and 6 cSt. Group III base oils. Comparative Example 8 was blended using a commercially available VM concentrate containing 6 mass % of the same copolymer as used in Example 1, in a Group I diluent oil (Comparative Example 7). Inventive Examples 9 and 10 were blended using the concentrate of Example 5.

TABLE 2

| SAE 10W-40 @ KV100 = 13.85 cSt | Example 8 | Example 9 | Example 10 |
|---|---|---|---|
| Additive Package | 21.20 | 21.20 | 21.20 |
| Example 7 | 12.60 | | |
| Example 5 | | 12.06 | 10.25 |
| 4 cSt. Group III | 10.20 | 10.74 | |
| 6 cSt. Group III | 56.00 | 56.00 | 68.55 |
| VM Treat (%) | 0.76 | 0.72 | 0.62 |
| HTHS @ 150° C. (cP) | 3.95 | 3.97 | 4.01 |
| KV @ 100° C. (cSt) | 13.84 | 13.85 | 13.83 |
| CCS @ −25° C. (cP) | 6500 | 5620 | 6520 |
| MRV YS @ −25° C. (cP) | Y ≤ 35 | Y ≤ 35 | Y ≤ 35 |
| Noack | 8.8 | 7.8 | 7.2 |

As shown, the formulation of Example 9, blended with the VM concentrate of Example 5, provided a significantly lower CCS @-25° C. value compared to the formulation of Example 8. This CCS credit allows for the substitution of higher amounts of heavier (6 cSt.) base oils and a concurrent reduction in the amount VM needed to provide the selected KV100 value (see Example 10), which can result in significantly reduced Noack volatility, as well as a potential reduction in engine deposits.

Table 3 presents the results of a blend study on 5W-30 grade heavy duty diesel (HDD) formulations, each blended to have a $k_{\nu 100}$ value of 12.40 cSt using the same commercial additive package containing dispersant, detergent and anti-wear agents and either a 4 cSt. Group III base oil, or a basestock blend of 4 cSt. and 6 cSt. Group III base oils both with, and without an amount of a Group V base oil (PAO), commonly added as a correction fluid. Comparative Examples 11 and 12 were blended using a commercially available VM concentrate containing 6 mass % of the same copolymer as used in Example 1, in a Group I diluent oil (Comparative Example 7). Inventive Examples 13 and 14 were blended using the concentrate of Example 6.

TABLE 3

| SAE 5W-30 @ KV100 = 12.40 cSt | Example 11 | Example 12 | Example 13 | Example 14 |
|---|---|---|---|---|
| Additive Package | 20.20 | 20.20 | 20.20 | 20.20 |
| PPD | 0.30 | 0.30 | 0.30 | 0.30 |
| Example 7 | 16.00 | 15.43 | | |
| Example 6 | | | 15.15 | 14.61 |
| 4 cSt. PAO | 20.00 | | 20.00 | |
| 4 cSt. Group III | 28.50 | 49.07 | 29.35 | 49.89 |
| 6 cSt. Group III | 15.00 | 15.00 | 15.00 | 15.00 |
| VM Treat (%) | 0.96 | 0.93 | 0.91 | 0.88 |
| HTHS @ 150° C. (cP) | 3.53 | 3.55 | 3.54 | 3.56 |
| KV @ 100° C. (cSt) | 12.41 | 12.38 | 12.42 | 12.39 |
| CCS @ −30° C. (cP) | 6100 | 7330 | 5140 | 6120 |
| MRV YS @ −35° C. (cP) | Y ≤ 35 | Y ≤ 35 | Y ≤ 35 | Y ≤ 35 |
| Noack | 11.7 | 12.1 | 10.0 | 10.3 |

As shown, a lubricant formulated with the VM concentrate of comparative Example 7 required a high treat rate (20 mass %) of PAO correction fluid to maintain $K_{\nu 100}$, Noack and CCS-30° C. within limits, while the use of the inventive VM concentrate of Example 6 allowed for the blending of a lubricant providing all viscometric parameters within limit, and a lower Noack volatility value, with a reduced polymer treat rate and without any PAO correction fluid.

The disclosures of all patents, articles and other materials described herein are hereby incorporated, in their entirety, into this specification by reference. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention. Further, when used to describe combinations of components (e.g., VI improver, PPD and oil), the term "comprising" should be construed to include the composition resulting from admixing of the noted components.

What is claimed is:

1. A viscosity modifier concentrate consisting essentially of from about 5 to about 15 mass % of a linear di- or tri-block copolymer, and optionally from about 0.1 to about 5 mass % of lubricating oil flow improver (LOFI) and/or from about 0.1 to about 1 mass % of antioxidant (AO), in a selected diluent oil or diluent oil blend, wherein said di- or tri-block copolymer comprises a first block derived from monoalkenyl arene covalently linked to one or more blocks derived from diene; wherein said selected diluent oil or diluent oil blend consists essentially of Group II diluent oil, Group III diluent oil or a mixture of Group III and Group II diluent oil and has, or has on average, a total saturates content of greater than 90 mass %, a viscosity index (VI) of at least 120, and a sulfur content of no greater than 0.3 mass %, and wherein said first block of said di- or tri-block copolymer has a weight average molecular weight whereby said di- or tri-block copolymer has a $\Delta kv_{100}$ value of no greater than 0.3, wherein $\Delta kv_{100}$ is the difference, as measured at 100° C. (ASTM D445) between the $kv_{100}$ of a first blend and a second blend of 1 mass % of said di- or tri-block copolymer in said selected diluent oil or diluent oil blend, said first blend being prepared at a temperature below the glass transition temperature (Tg) of said monoalkenyl arene and said second blend being prepared at a temperature between the glass transition temperature of the monoalkenyl arene material and the decomposition temperature of said monoalkenyl arene, wherein said monoalkenyl arene is styrene or an alkylated derivative thereof, said one or more blocks derived from diene are derived from a mixture of isoprene and butadiene and have a weight ratio of polymer derived from isoprene to a polymer derived from butadiene of from about 90:10 to about 70:30, said linear di- or tri-block copolymer has a weight average molecular weight of from about 45,000 daltons to about 250.000 daltons, said first block of said linear di- or tri-block copolymer has a weight average molecular weight of at least 4000 daltons and comprises from about 20 mass % to about 50 mass % of said di- or tri-block copolymer, and wherein said selected diluent oil or diluent oil blend has, or has on average, a CCS at −35° C. of less than 3700 cPs and a kinematic viscosity at 100° C. ($kv_{100}$) of from about 3 cSt to about 6 cSt.

2. The concentrate of claim 1, wherein said linear di- or tri-block copolymer is a linear di-block copolymer.

3. The concentrate of claim 1, wherein said linear di-block copolymer has a weight average molecular weight of from about 45,000 daltons to about 130,000 daltons.

4. The concentrate of claim 1, wherein said one or more blocks derived from diene have a weight ratio of polymer derived from isoprene to a polymer derived from butadiene of from about 85:15 to about 75:25.

5. The concentrate of claim 1, wherein at least about 90 mass % of the butadiene is incorporated into the polymer as 1, 4 units.

6. The concentrate of claim 1, wherein said selected diluent oil or diluent oil blend has, or has on average, a CCS at −35° C. of less than 2500 cPs.

* * * * *